US007491156B1

(12) United States Patent
GaoYong

(10) Patent No.: US 7,491,156 B1
(45) Date of Patent: Feb. 17, 2009

(54) FIXED WEIGHT DUMBBELL AND BARBELL SYSTEM

(76) Inventor: Jia GaoYong, 1608A Vanke City Garden, Zhengyi Road, Tianjin (CN)

( * ) Notice: Subject to any disclaimer, the term of this patent is extended or adjusted under 35 U.S.C. 154(b) by 0 days.

(21) Appl. No.: 11/906,246

(22) Filed: Oct. 1, 2007

(51) Int. Cl.
*A63B 21/00* (2006.01)

(52) U.S. Cl. ..... 482/108; 482/106

(58) Field of Classification Search ..... 482/102–109
See application file for complete search history.

(56) References Cited

U.S. PATENT DOCUMENTS 1,438,804 A * 12/1922 Albizu ..... 482/108
2,447,218 A * 8/1948 Trzesniewski ..... 482/106
2004/0180763 A1* 9/2004 Wawrzyniak ..... 482/107
2007/0197354 A1* 8/2007 Januszek ..... 482/107

FOREIGN PATENT DOCUMENTS

WO WO 2005/070502 A2 8/2005

* cited by examiner

*Primary Examiner*—Jerome Donnelly

(57) ABSTRACT

A handle has enlargements between a central gripping section and cylindrically shaped opposed end sections. The opposed end sections have free ends formed with male screw threads for the minority of their axial extents. A pair of weights are similarly configured. Each weight includes an inner center, coated outer layer, and a central cylindrical bore, and bushings in the bore. A locking nut is coupled to each free end of the handle. The diameter of the free ends of the handle is less than the diameter of the bushings for the rotatable coupling there between. An end cap is secured with respect to each weight. Screws extend through each end cap and outer layer. The screws extend into the inner center to join the end caps with respect to the weights.

1 Claim, 2 Drawing Sheets

FIXED WEIGHT DUMBBELL AND BARBELL SYSTEM

BACKGROUND OF THE INVENTION

1. Field of the Invention

The present invention relates to a fixed weight dumbbell and barbell system and more particularly pertains to facilitating exercising in a safe, convenient and economical manner.

2. Description of the Prior Art

The use of exercise devices of known designs and configurations is known in the prior art. More specifically, exercise devices of known designs and configurations previously devised and utilized for the purpose of facilitating exercise through known methods and apparatuses are known to consist basically of familiar, expected, and obvious structural configurations, notwithstanding the myriad of designs encompassed by the crowded prior art which has been developed for the fulfillment of countless objectives and requirements.

By way of example, International Publication Number WO 2005/070502 A2 published 4 Aug. 2005 discloses "An Exercise Device".

While this device fulfills its particular objectives and requirements, the aforementioned patent does not describe a fixed weight dumbbell and barbell system that allows for facilitating exercising in a safe, convenient and economical manner.

In this respect, the fixed weight dumbbell and barbell system according to the present invention substantially departs from the conventional concepts and designs of the prior art, and in doing so provides an apparatus primarily developed for the purpose of facilitating exercising in a safe, convenient and economical manner.

Therefore, it can be appreciated that there exists a continuing need for a new and improved fixed weight dumbbell and barbell system which can be used for facilitating exercising in a safe, convenient and economical manner. In this regard, the present invention substantially fulfills this need.

SUMMARY OF THE INVENTION

In view of the foregoing disadvantages inherent in the known types of exercise devices of known designs and configurations now present in the prior art, the present invention provides an improved fixed weight dumbbell and barbell system. As such, the general purpose of the present invention, which will be described subsequently in greater detail, is to provide a new and improved fixed weight dumbbell and barbell system and method which has all the advantages of the prior art and none of the disadvantages.

To attain this, the present invention essentially comprises a fixed weight dumbbell and barbell system. First provided is a generally cylindrical handle. The handle has a central gripping section. The handle has cylindrically shaped opposed end sections. The handle has enlargements. The enlargements are provided between the central gripping section and the opposed end sections. The end sections have a diameter and an axial length. The diameter and axial length of the end sections are less than the diameter and axial length of the central gripping section. The opposed end sections have free ends. The free ends have male screw threads. The male screw threads are provided on the minority of their axial extents. The enlargements have planar bearing surfaces. The planar bearing surfaces face away from the central gripping section. The handle is fabricated of stainless steel.

A pair of similarly configured weights is provided. Each weight includes a cast iron inner center. Each weight includes a rubber coated outer layer. Each inner center has a torus-shaped configuration. Each inner center has a planar outwardly facing surface. Each inner center has a parallel planar inwardly facing surface. Each weight has a central cylindrical bore. Each weight has a periphery. The periphery extends between the surfaces. Each outwardly facing surface has a recess. In this manner an axially extending face and a radially extending face are provided. A pair of copper bushings is provided. The copper bushings have inner and outer axial components. The inner and outer axial components are press fit into the bore from the inwardly and outwardly facing surfaces. The copper bushings have inner and outer radial components. The inner and outer radial components are in contact with the inwardly facing surface of the inner center and the radially extending face of the recess. The combined lengths of the axial components for each inner center are less than the axial length of its associated inner center. A gap is provided between the bushings of each weight.

Provided next is a locking nut. The locking nut has female threads. The female threads threadedly coupled to each free end of the handle. In this manner one weight is secured on each free end of the handle. The diameter of the free ends of the handle are less than the diameter of the bushings. In this manner the weight and the handle may be rotatably coupled. Each inner radial component is in sliding contact with an adjacent bearing surface of the enlargement. Each outer radial component is in bearing contact with an adjacent locking nut.

An end cap is provided. The end cap is secured with respect to each weight. The end cap includes a generally planar first part. The first part has a circular section. The circular section is in contact with the outer layer. The circular section overlies the exterior surface of the inner center. The end cap has an outwardly extending ledge. The end cap includes a generally planar second part. The second part overlies the first part. The second part has a peripheral section. The peripheral section is in contact with the outer layer. The peripheral section overlies the exterior surface of the inner center. The end cap has a recessed center.

Further provided are three equally spaced screws. The screws extend through each end cap and outer layer and. The screws further extend into the inner center. In this manner the screws join the end caps with respect to the weights. Each screw has a head. The head is in contact with a second part of an end cap.

Provided last is a brand label. The brand label is adhesively secured to the recessed center of the second part of each end cap. In this manner the screws are hidden. Indicia are provided. Further in this manner an exposed surface is provided for the indicia.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fixed weight dumbbell and barbell system which has all of the advantages of the prior art exercise devices of known designs and configurations and none of the disadvantages.

It is another object of the present invention to provide a new and improved fixed weight dumbbell and barbell system which may be easily and efficiently manufactured and marketed.

It is further object of the present invention to provide a new and improved fixed weight dumbbell and barbell system which is of durable and reliable constructions.

An even further object of the present invention is to provide a new and improved fixed weight dumbbell and barbell system which is susceptible of a low cost of manufacture with regard to both materials and labor, and which accordingly is then susceptible of low prices of sale to the consuming public, thereby making such fixed weight dumbbell and barbell system economically available to the buying public.

Even still another object of the present invention is to provide a fixed weight dumbbell and barbell system for facilitating exercising in a safe, convenient and economical manner.

Lastly, it is an object of the present invention to provide a new and improved fixed weight dumbbell and barbell system. A handle of the system has enlargements between a central gripping section and cylindrically shaped opposed end sections. The opposed end sections have free ends formed with male screw threads for the minority of their axial extents. A pair of weights are similarly configured. Each weight includes an inner center, coated outer layer, and a central cylindrical bore, and bushings in the bore. A locking nut is coupled to each free end of the handle. The diameter of the free ends of the handle is less than the diameter of the bushings for the rotatable coupling there between. An end cap is secured with respect to each weight. Screws extend through each end cap and outer layer. The screws extend into the inner center to join the end caps with respect to the weights. These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
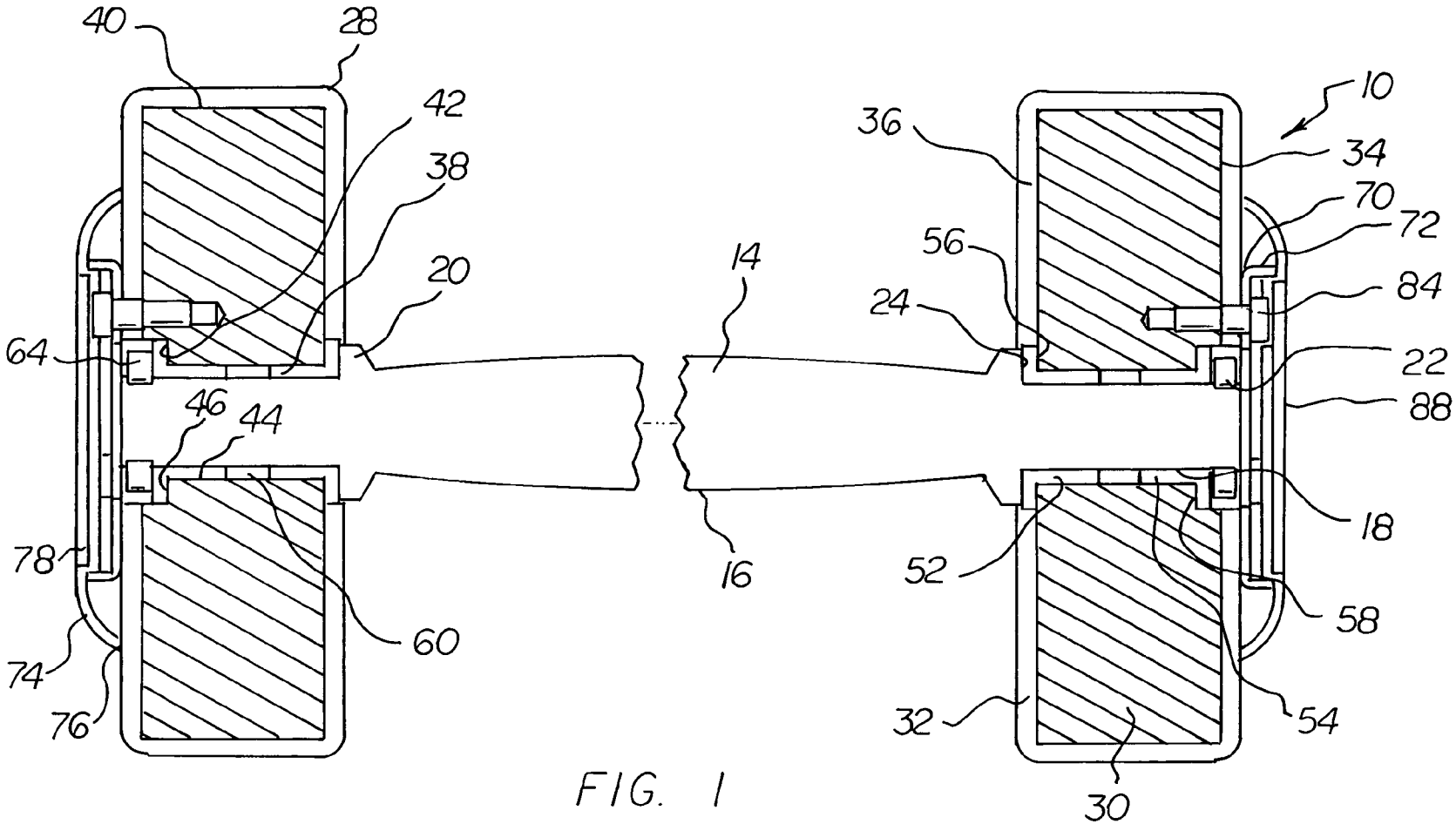
FIG. 1 is a cross sectional view of a fixed weight dumbbell and barbell system constructed in accordance with the principles of the present invention, the view taken centrally through the axis of the system.
Figure 2:
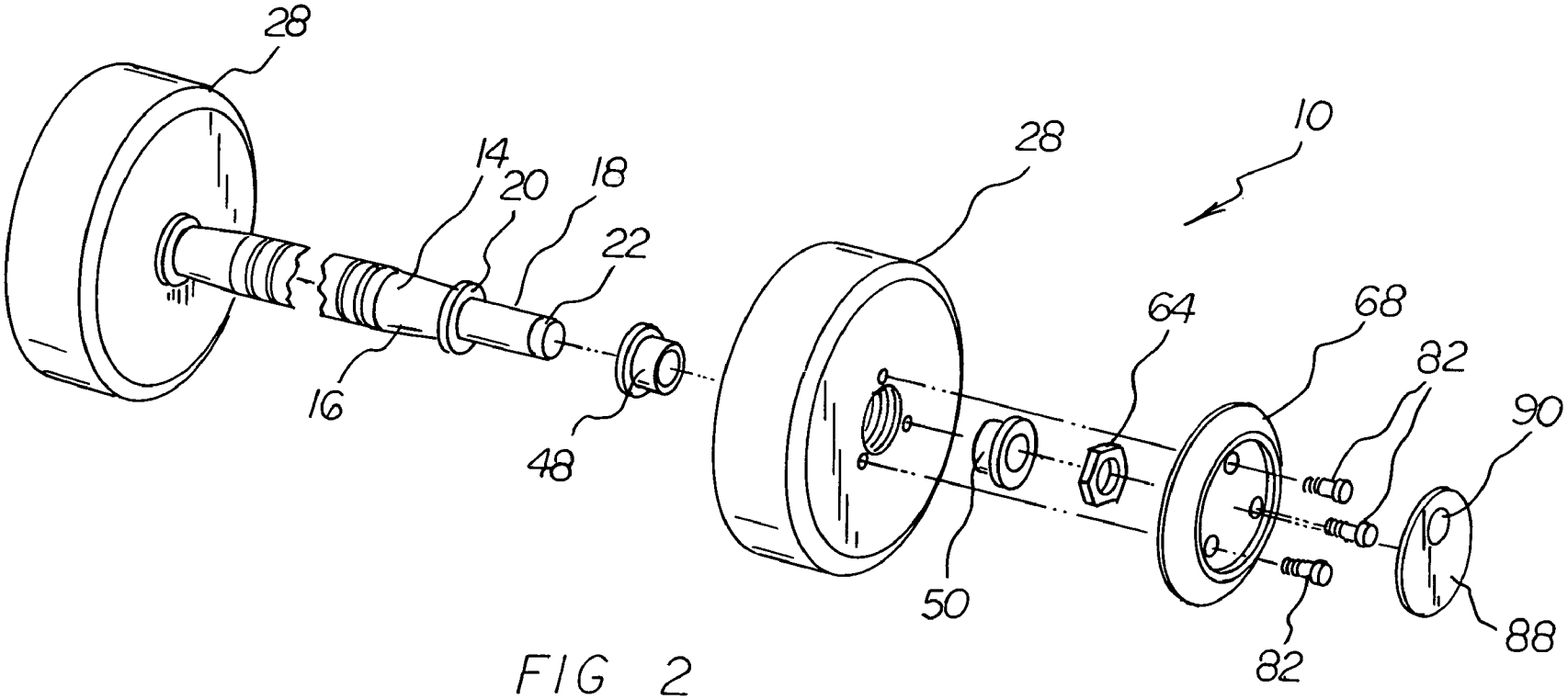
FIG. 2 is an exploded perspective illustration of the fixed weight dumbbell and barbell system shown in FIG. 1.

With reference now to the drawings, and in particular to FIG. 1 thereof, the preferred embodiment of the new and improved fixed weight dumbbell and barbell system embodying the principles and concepts of the present invention and generally designated by the reference numeral 10 will be described.

The present invention, the fixed weight dumbbell and barbell system 10 is comprised of a plurality of components. Such components in their broadest context include a handle, a pair of similarly configured weights, a locking nut, an end cap and screws. Such components are individually configured and correlated with respect to each other so as to attain the desired objective.

First provided is a generally cylindrical handle 14. The handle has a central gripping section 16. The handle has cylindrically shaped opposed end sections 18. The handle has enlargements 20. The enlargements are provided between the central gripping section and the opposed end sections. The end sections have a diameter and an axial length. The diameter and axial length of the end sections are less than the diameter and axial length of the central gripping section. The opposed end sections have free ends. The free ends have male screw threads 22. The male screw threads are provided on the minority of their axial extents. The enlargements have planar bearing surfaces 24. The planar bearing surfaces face away from the central gripping section. The handle is fabricated of stainless steel.

A pair of similarly configured weights 28 is provided. Each weight includes a cast iron inner center 30. Each weight includes a rubber coated outer layer 32. In the alternative the outer layer is fabricated of an elastomeric material selected from the class of elastomeric materials including plastic and rubber, natural and synthetic, and blends thereof.

Each inner center has a torus-shaped configuration. Each inner center has a planar outwardly facing surface 34. Each inner center has a parallel planar inwardly facing surface 36. Each weight has a central cylindrical bore 38. Each weight has a periphery 40. The periphery extends between the surfaces. Each outwardly facing surface has a recess 42. In this manner an axially extending face 44 and a radially extending face 46 are provided. A pair of copper bushings 48, 50 is provided. The copper bushings have inner and outer axial components 52, 54. The inner and outer axial components are press fit into the bore from the inwardly and outwardly facing surfaces. The copper bushings have inner and outer radial components 56, 58. The inner and outer radial components are in contact with the inwardly facing surface of the inner center and the radially extending face of the recess. The combined lengths of the axial components for each inner center are less than the axial length of its associated inner center. A gap 60 is provided. The gap is provided between the bushings of each weight.

Provided next is a locking nut 64. The locking nut has female threads. The female threads threadedly coupled to each free end of the handle. In this manner one weight is secured on each free end of the handle. The diameter of the free ends of the handle is less than the diameter of the bushings. In this manner the weight and the handle may be rotatably coupled. Each inner radial component is in sliding contact with an adjacent bearing surface of the enlargement. Each outer radial component is in bearing contact with an adjacent locking nut.

An end cap 68 is provided. The end cap is secured with respect to each weight. The end cap includes a generally planar first part 70. The first part has a circular section. The circular section is in contact with the outer layer. The circular section overlies the exterior surface of the inner center. The end cap has an outwardly extending ledge 72. The end cap includes a generally planar second part 74. The second part overlies the first part. The second part has a peripheral section 76. The peripheral section is in contact with the outer layer. The peripheral section overlies the exterior surface of the inner center. The end cap has a recessed center 78.

Further provided are three equally spaced screws 82. The screws extend through each end cap and outer layer and. The screws further extend into the inner center. In this manner the screws join the end caps with respect to the weights. Each screw has a head 84. The head is in contact with a second part of an end cap.

Provided last is a brand label 88. The brand label is adhesively secured to the recessed center of the second part of each end cap. In this manner the screws are hidden. Indicia 90 are provided. Further in this manner an exposed surface is provided for the indicia.

Important structural features of the present invention includes two copper bushings which lock tightly inside the cast iron center. A slight gap is formed between the inner diameter of the copper bushing and the handle. There is also a slight gap between the locking nut and the dumbbell end. The locking nuts are welded at the end of the handle. Further three screws lock each metal end cap to a dumbbell end. A brand label is stuck on the end to cover up the screws.

Due to these structural features, the dumbbell ends will be able to rotate at the end of the handle in order to reduce the force of resistance exerted on a user's wrists when lifting heavy weights. The brand label covering up the screws at the dumbbell end make the invention more appealing. This label may be customized for different customer's private labels.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fixed weight dumbbell and barbell system to facilitate exercising in a safe, convenient and economical manner comprising, in combination:

a generally cylindrical handle having a central gripping section and cylindrically shaped opposed end sections with enlargements between the central gripping section and the opposed end sections, the end sections having a diameter and an axial length less than the diameter and axial length of the central gripping section, the opposed end sections having free ends formed with male screw threads for the minority of their axial extents, the enlargements being formed with planar bearing surfaces facing away from the central gripping section, the handle being fabricated of stainless steel;

a pair of similarly configured weights, each weight including a cast iron inner center and a rubber coated outer layer, each inner center having a torus-shaped configuration with a planar outwardly facing surface and a parallel planar inwardly facing surface with a central cylindrical bore and a periphery extending between the surfaces, each outwardly facing surface being formed with a recess providing an axially extending face and a radially extending face, a pair of copper bushings with inner and outer axial components press fit into the bore from the inwardly and outwardly facing surfaces and inner and outer radial components in contact with the inwardly facing surface of the inner center and the radially extending face of the recess, the combined lengths of the axial components for each inner center being less than the axial length of its associated inner center to thereby form a gap between the bushings of each weight;

a locking nut with female threads threadedly coupled to each free end of the handle for securing one weight on each free end of the handle, the diameter of the free ends of the handle being less than the diameter of the bushings for the rotatable coupling there between the weight and the handle and with each inner radial component in sliding contact with an adjacent bearing surface of the enlargement and each outer radial component in bearing contact with an adjacent locking nut;

an end cap secured with respect to each end of the handle, the end cap including a generally planar first part having a circular section in contact with the outer layer overlying the exterior surface of the inner center and outwardly extending ledge, the end cap including a generally planar second part overlying the first part and having a peripheral section in contact with the outer layer overlying the exterior surface of the inner center and a recessed center;

three equally spaced screws extending through each end cap and outer layer and extending into the inner center to join the end caps with respect to the weights, each screw having a head in contact with a second part of an end cap; and a brand label adhesively secured to the recessed center of the second part of each end cap to hide the screws and providing an exposed surface for indicia.

* * * * *